US005542528A

United States Patent [19]

Lanfranconi et al.

[11] Patent Number: 5,542,528

[45] Date of Patent: Aug. 6, 1996

[54] BOTTLE FOR PRESERVING IN A SEPARATED CONDITION SUBSTANCES TO BE MIXED TOGETHER BEFORE DISPENSING

[75] Inventors: Antonio Lanfranconi; Giorgio Munari, both of Milan; Adelelmo Zappettini, Garbagnate Milanese; Roberto Rizzo, Rho, all of Italy

[73] Assignee: INGE S.p.A., Milan, Italy

[21] Appl. No.: 266,851

[22] Filed: Jul. 5, 1994

[30] Foreign Application Priority Data

Jul. 5, 1993 [IT] Italy ..... MI93A1452

[51] Int. Cl.[6] ..... B65D 51/28

[52] U.S. Cl. ..... 206/221; 215/DIG. 8; 215/227; 215/317

[58] Field of Search ..... 206/219, 221; 215/DIG. 8, 227, 272, 317

[56] References Cited

U.S. PATENT DOCUMENTS

| | | | |
|---|---|---|---|
| 2,974,785 | 3/1961 | Griffon | 206/221 |
| 4,195,730 | 4/1980 | Hunt | 206/221 |
| 4,386,696 | 6/1983 | Goncalves | 206/221 |
| 4,865,189 | 9/1989 | Guerra et al. | 206/221 |

FOREIGN PATENT DOCUMENTS

| | | |
|---|---|---|
| 523497 | 10/1953 | Belgium . |
| 0520616 | 5/1992 | European Pat. Off. . |
| 4238819 | 11/1992 | Germany . |

*Primary Examiner*—Jacob K. Ackun

*Attorney, Agent, or Firm*—Cushman Darby & Cushman, L.L.P.

[57] ABSTRACT

The bottle (1) comprises a body (5) closed by a capsule (8). Within the capsule (8) there is a separator element (9) which closes its concavity to prevent mixing of the substances contained in the capsule (8) and in the body (5) respectively. To mix the substances the separator element (9) is removed by deforming the capsule (8).

To prevent the bottle (1) being able to be opened without mixing of the substances having taken place, the outer surface (15) of the capsule (8) and the inner surface (6) of the container mouth (4) carry respectively an annular projection (14) and an undercut ledge (7) which mutually engage only by the effect of the radial expansion of the capsule (8) when the separator (9) is closed.

7 Claims, 2 Drawing Sheets

BOTTLE FOR PRESERVING IN A SEPARATED CONDITION SUBSTANCES TO BE MIXED TOGETHER BEFORE DISPENSING

BACKGROUND OF THE INVENTION

This invention relates to a bottle for containing substances in a separated condition.

Bottles in accordance with the classifying part of claim one are known.

Such bottles were invented mainly to increase the preservation time of compounds which if bottled ready for use would have been chemically very unstable. Such containers are commonly used in the pharmaceutical field to maintain a solute in powder or granule form separate from a liquid solvent.

It happens, however, that persons lacking in experience remove the capsule and ignore its contents. This happens mainly if the solute is contained in a particularly small quantity such as to be practically invisible from the outside of the capsule, even if this is of a transparent plastics material. It is apparent that in such cases the administration of the medicine has only a psychological effect and hence hardly therapeutic.

SUMMARY OF THE INVENTION

The object of the present invention is to obviate the aforesaid drawback, which occurs with a greater frequency than might be thought, by providing a bottle which enables a solute to be preserved separated from a solvent while at the same time making it impossible to administer one without the other.

In this container it is not possible to remove the closure element and hence open it if the separator element has not been previously removed from the interior of the capsule. This ensures that the solute and solvent meet by gravity before the container is opened.

BRIEF DESCRIPTION OF THE DRAWINGS

The invention is illustrated by way of non-limiting example in the figures of the accompanying drawings.

DETAILED DESCRIPTION

Figure 1:
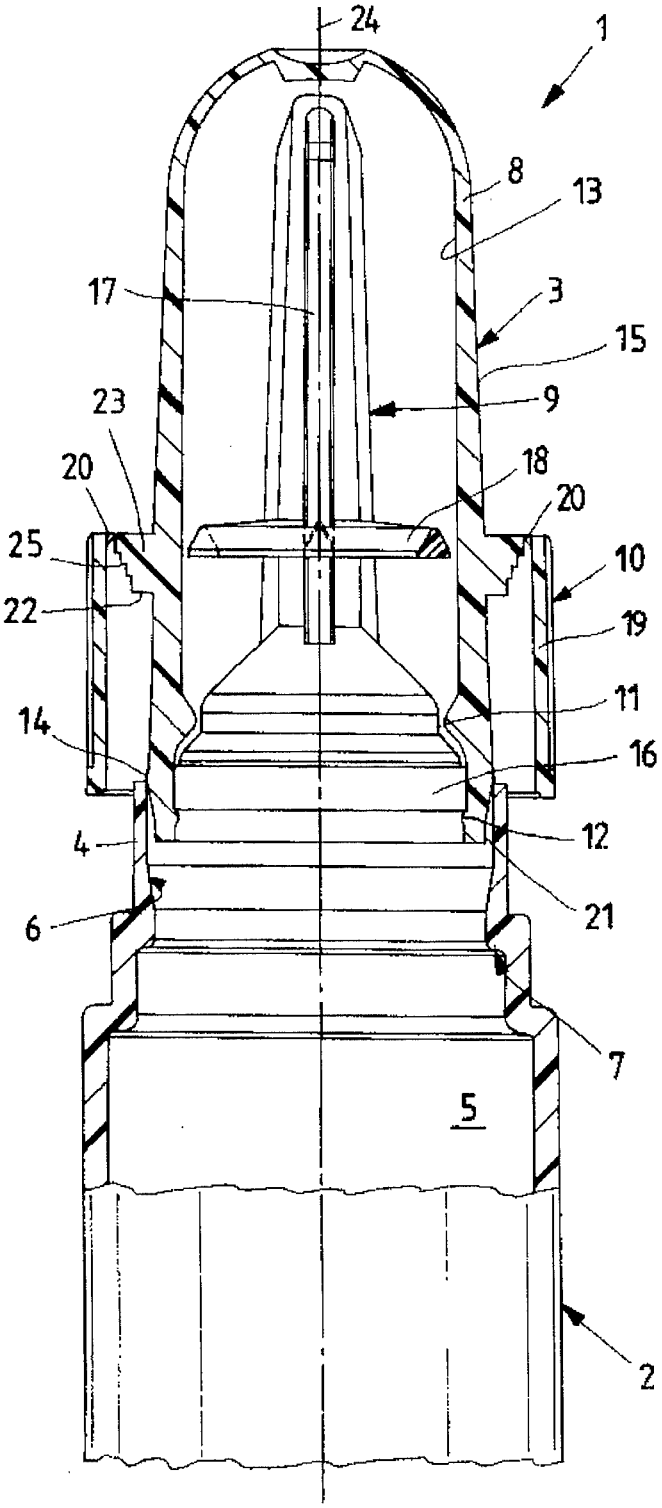
FIG. 1 is a partly sectional view showing a bottle according to the invention undergoing closure by the relative device.
Figure 4:
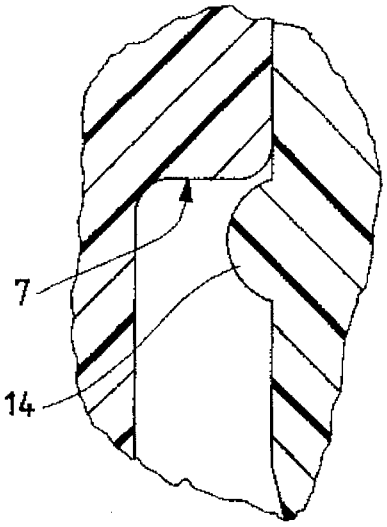
FIG. 4 is an enlarged detail of the bottle closure element.
Figure 3:
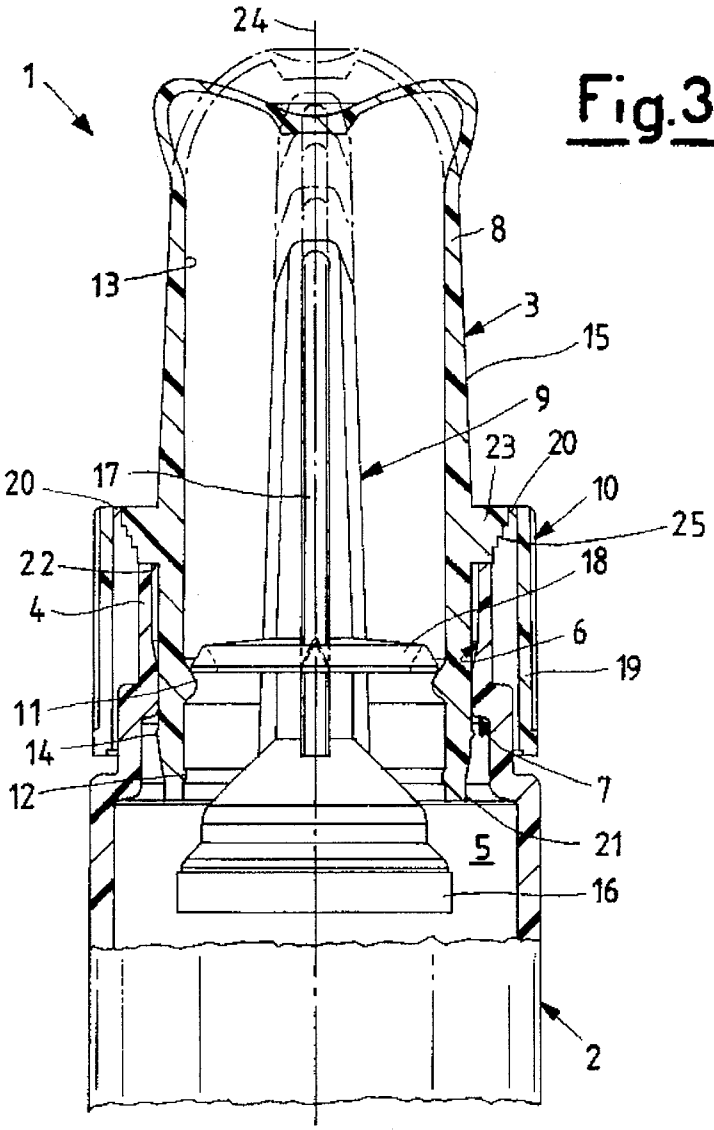
FIG. 3 is a partly sectional view showing the bottle during the removal of the stopper portion from the interior of the capsule.
Figure 2:
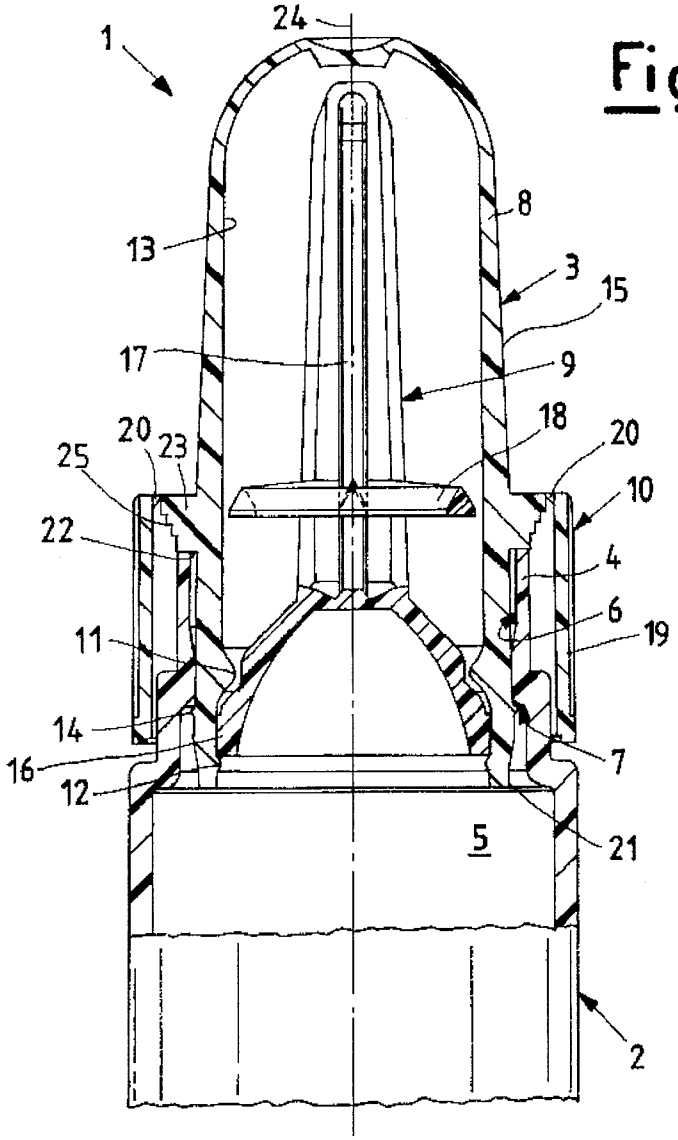
FIG. 2 is a partly sectional view showing the bottle closed.

With reference to the aforesaid figures, the bottle according to the invention, indicated overall by 1, is formed from a container 2 and a closure element 3. The container 2 and the closure element 3 are both preferably of plastics material, but of different characteristics. Specifically, the container 2 is of substantially rigid material whereas the closure element 3 is of substantially flexible material. The container 2 comprises a mouth 4 and a container body 5. The mouth 4 is provided on its inner surface 6 with an undercut ledge 7 the function of which will be apparent hereinafter. The closure element 3 comprises a capsule 8, a separator element

9 and a seal 10. The capsule 8 comprises a first inner projection 11 and a second inner projection 12 (ie provided on the inner surface 13 of the capsule) and an outer projection 14 (i.e. provided on the outer surface 15 of the capsule). The separator element 9 comprises a stopper portion 16 and a stem 17 to which an annular element 18 or disc portion is fixed. The security seal 10 is formed from a tubular element 19 of circular cross-section fixed to the capsule 8 by breakable strips 20, the security seal 10 hence being of the predetermined breakage type. The tubular element 19 is of such a size that when the capsule is mounted it covers the point at which this latter engages the mouth 4 of the container 2. In this manner the seal can perform its security-function.

Preparation, which can be done by automatic machines, comprises substantially a stage of filling the capsule 8 with the solute and closing it by adequately forced insertion of the separator element 9. The stopper portion 16 of the element 9 fits between the first inner projection 11 and second inner projection 12, causing radial expansion of the capsule at the end which is to be inserted into the container mouth 4. The closure element is then fitted to the container in which the solvent has been previously placed. To facilitate insertion of the radially expanded end into the mouth 4 of the container 2, the end is preferably provided with a bevel 21 which even if expanded still has an outer diameter less than the inner diameter of the mouth 4. Insertion stops when the container mouth 4 encounters an abutment 22 provided on a flange 23 which in the illustrated example is that from which the strips 20 project perpendicular to the axis 24 of the bottle 1. By the effect of the radial expansion of the capsule, the outer projection 14 on the capsule becomes positioned in engagement with the undercut ledge 7 to lock the two elements 2 and 3 together. The dimensions and structure of these two elements can also be different provided a non-releasable connection is made by the effect of the radial expansion of that capsule portion inserted into the container mouth 4. The presence of this connection also enables the structure of the security seal to be substantially simplified, with obvious constructional and economic advantages. In this respect, in the illustrated example the security seal is tendentially simple.

The strips 20 are positioned at the top end of the flange 23 so that the tubular element 19 completely covers the lateral surface of said flange 23. This lateral surface is shaped in steps with progressively decreasing diameters from the top downwards. The lateral surface of the flange 23 is therefore easy to grip, and once the tubular element 19 has been removed this surface represents the natural gripping element for removing the closure element 3 from the container body 5. In addition, the capsule 8 and security seal 10 can be easily formed by a single moulding operation, as the tubular element 19, the strips 20 or the steps 25 do not represent undercuts for the moulding core.

Security seals of a different structure can however be used. Notwithstanding its structural simplicity the security seal 10 is effective because a person attempting to open the capsule would grip it at the portion of greatest rigidity, i.e. at the flange 23, which, however, is protected by the tubular element 19. Breakage of the strips 20 separates the tubular element 19 from the closure element 3, hence indicating that violation or attempted violation has taken place. To be able to remove the closure element 3 and hence open the container 2 it is sufficient to press on the capsule 8 so that the separator element 9 is freed from its closure seat, so releasing the solute, which falls into the solvent by gravity. As the container is still closed, the bottle can be shaken to achieve proper mixing without the contents escaping.

The annular element or disc 18 halts against the first annular projection 11 to prevent the separator element 9 from falling into the container 2. The elasticity of the capsule 8 causes radial contraction of the end portion previously engaged by the stopper portion 16 of the separator element 9. The outer projection 14 disengages from the undercut ledge 7 to release the closure element 3 from the mouth 4 of the container, which can hence be easily opened. Hence the bottle 1 can be opened only if the solute meets the solvent.

We claim:

1. A bottle for preserving in a separated condition substances to be mixed together before dispensing, comprising:

a container having a mouth having an inner surface, a closure element applicable to said mouth of said container, said closure element comprising a capsule of deformable material having a concavity, an inner surface and an outer surface and a separator element which closes said concavity of said capsule by means of a stopper portion arranged to engage said inner surface of said capsule, said outer surface of said capsule and said inner surface of said mouth of said container being mutually engageable and carrying mutual locking means which comprise at least one outer projection arranged to cooperate with at least one undercut and which are activated by radial expansion determined by the insertion of said stopper portion into said capsule.

2. A bottle as claimed in claim 1, wherein:

said projection is provided on said outer surface of said capsule, and said undercut is provided on said inner surface of said mouth of said container.

3. A bottle as claimed in claim 1, wherein:

said outer projection is annular.

4. A bottle as claimed in claim 1, wherein:

said separator element is formed from said stopper portion, a stem and a stop disc positioned on said stem and arranged to engage at least one projection provided on said inner surface of said capsule, to prevent said separator element from falling into said container during mixing.

5. A bottle as claimed in claim 1, further comprising:

a security seal extending to cover a point of engagement of said capsule with said container.

6. A bottle as claimed in claim 5, wherein:

said security seal comprises a tubular element of circular cross-section fixed to said capsule by predetermined breakage strips.

7. A bottle as claimed in claim 6, wherein:

said strips are positioned at the upper end of a flange, said flange being relatively rigid and having a lateral surface shaped with steps having a decreasing diameter in a downward direction.

* * * * *